US011359453B2

(12) United States Patent
Kent

(10) Patent No.: US 11,359,453 B2
(45) Date of Patent: Jun. 14, 2022

(54) PACKER SETTING DEVICE

(71) Applicant: SBS TECHNOLOGY AS, Indre Arna (NO)

(72) Inventor: Anthony Kent, Houston, TX (US)

(73) Assignee: SBS Technology AS, Indre Arna (NO)

( * ) Notice: Subject to any disclaimer, the term of this patent is extended or adjusted under 35 U.S.C. 154(b) by 149 days.

(21) Appl. No.: 16/702,774

(22) Filed: Dec. 4, 2019

(65) Prior Publication Data

US 2020/0182007 A1 Jun. 11, 2020

(30) Foreign Application Priority Data

Dec. 5, 2018 (NO) ..... 20181561

(51) Int. Cl.
*E21B 33/12* (2006.01)
*E21B 34/10* (2006.01)

(52) U.S. Cl.
CPC ..... *E21B 33/12* (2013.01); *E21B 34/10* (2013.01)

(58) Field of Classification Search
CPC combination set(s) only.
See application file for complete search history.

(56) References Cited

U.S. PATENT DOCUMENTS

2019/0017345 A1* 1/2019 Brandsdal ..... E21B 33/1208

* cited by examiner

*Primary Examiner* — Sean D Andrish
(74) *Attorney, Agent, or Firm* — Phillip Black; Dossey & Jones PLLC

(57) ABSTRACT

Packer setting device, comprising a tubular (10) with a plug housing (14), said plug housing having an internal, through running boring (12) with an internal wall (12*a*), a breakable plug (16) seated in a load ring (22) axially movable within the boring (12) between a first position in where the plug (16) is with a distance to a breaking pin (18) and a second position in where the plug (16) is forced against the breaking pin (18), said load ring (22) is resting on a shear ring (20) with an annular shear lip (20*a*) to prevent axial movement in the first position until the shear lip (20*a*) is subjected to a force higher than a predetermined force, wherein the annular shear lip (20*a*) of the shear ring (20) extend radially inward in the boring (12), and the breaking pin (18) is resting on the shear ring (20), and said breaking pin (18) is accommodated in a pocket (28) on an outside of the load ring (22).

10 Claims, 8 Drawing Sheets

PACKER SETTING DEVICE

CROSS-REFERENCE TO RELATED APPLICATIONS

This application claims priority to Norwegian Patent Application No. NO20181561, filed on Dec. 5, 2018, which is incorporated by reference in its entirety herein.

FIELD OF THE INVENTION

The present invention relates to a packer setting device, comprising a tubular with a plug housing, said plug housing having an internal, through running boring with an internal wall, a breakable plug seated in a load ring axially movable within the boring between a first position in where the plug is with a distance to a breaking pin and a second position in where the plug is forced against the breaking pin.

BACKGROUND OF THE INVENTION

Packer setting devices are used as a barrier in a production tubing to be able to pressure up the production tubing for the purpose of setting a packer to seal of the annulus between the production tubing and a casing.

DISCLOSURE OF THE STATE OF ART

NO20171183A1 describes a completion pipe comprising a plug arrangement and a method for arranging a completion pipe in a well. The arrangement includes a disintegratable plug element arranged in a plug housing in a pipe string, a seal element arranged to seal between the plug element and the pipe string. The plug element is movable in the axial direction of the pipe string between a first position and a second position.

WO2016/195508A1 describes a plug comprising a crusher mechanism for a dissolvable sealing device, where the sealing device comprises one or more glass layers positioned in a wellbore.

US2017/096875A1 describes a rupture assembly that may be employed in the oilfield industry facilitates the deployment of a tubing string in a well.

OBJECTS OF THE PRESENT INVENTION

Some of the objects of the present invention is one or more of:

- provide a barrier device that can hold pressure and can to be placed inside a production tubing for the purpose of setting a packer
- provide a barrier device that can hold pressure and can be placed inside a production tubing for the purpose of preforming a pressure test of the production tubing
- provide a barrier device with a breakable plug to be able to remove the plug after it have served its purpose
- provide a barrier device with a plug which is partly dissolvable in well fluid
- provide a barrier device which is breakable and can allow the tubing to be filled up from the bottom while running in hole
- provide a barrier device which is breakable and can allow the tubing to be filled from the bottom while running in hole and can be closed when the tubing is at the desired depth.
- provide a mechanism for breaking a breakable plug that is strong enough to support a breakable plug and able to in a controlled and predictable manner to release the plug against a breaking member for breaking the plug and opening up a through bore.
- provide a mechanism for breaking a breakable plug that is cost effective to produce.
- provide a mechanism for breaking a breakable plug which can deliver predictable and repeatable shear values.

SUMMARY OF THE INVENTION

Said objectives are achieved with a packer setting device, comprising:

- a tubular with a plug housing, said plug housing having an internal, through running boring with an internal wall,
- a breakable plug seated in a load ring axially movable within the boring between a first position in where the plug is with a distance to a breaking pin and a second position in where the plug is forced against the breaking pin,
- said load ring is resting on a shear ring with an annular shear lip to prevent axial movement in the first position until the shear lip is subjected to a force higher than a predetermined force, wherein the annular shear lip of the shear ring extend radially inward in the boring, and
- the breaking pin is resting on the shear ring, and said breaking pin is accommodated in a pocket on an outside of the load ring.

The breaking pin can rest on an axially extending part of the shear ring.

The pocket accommodating the breaking pin can be a longitudinal and axial slit on the outside of the load ring.

The breakable plug can comprise a doughnut shaped seat made of breakable material, and a dissolvable insert made of dissolvable material.

The dissolvable insert can be is inserted or integrated in a central opening of the doughnut shaped seat.

The breakable plug can comprise a doughnut shaped seat made of breakable material, and a non-return valve disposed in a central opening of the doughnut shaped seat.

The non-return valve can in a first position be open to allow fluid flow through the valve, and in a second position, when the tubing is pressurized from top, the non-return valve can be closed to seal the plug.

The non-return valve can comprise a first annular peg with a number of radial openings, and a second annular peg with an axial peg boring, said second annular peg being inserted in the first annular peg.

The non-return valve can comprise a locking ring locking the valve in the second sealed position.

The non-return valve can be dissolvable.

DESCRIPTION OF THE FIGURES

Embodiments of the present invention will now be described, by way of example only, with reference to the following figures, wherein.

DESCRIPTION OF PREFERRED EMBODIMENTS OF THE INVENTION

Figure 1:
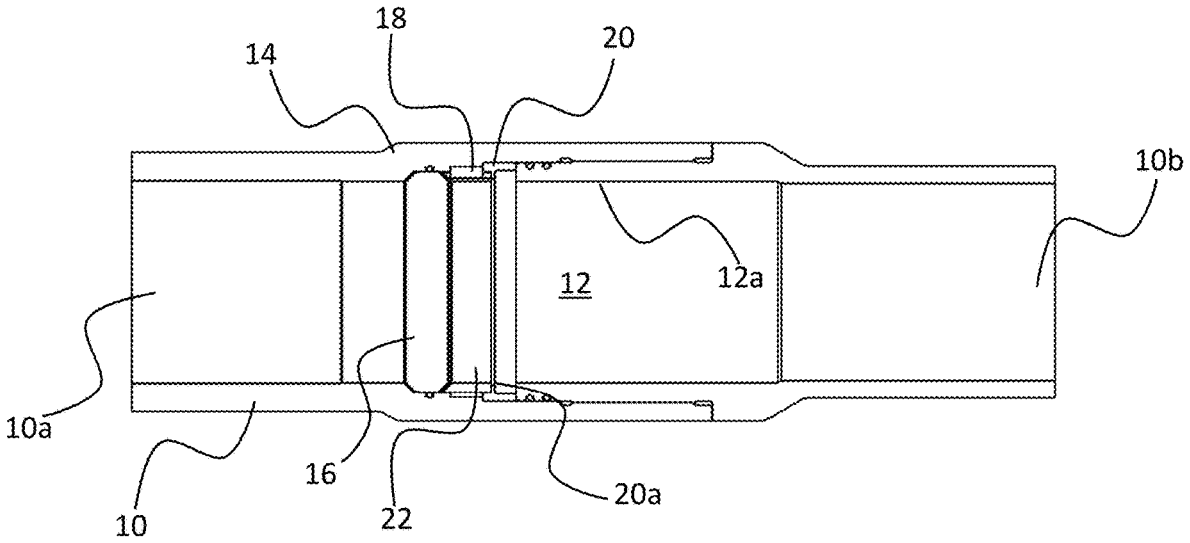
FIG. 1 shows a first embodiment of a packer setting device according to the invention.

FIG. 1 shows a first embodiment of a packer setting device according to the invention with a breakable, solid plug 16 made of glass or similar breakable material. The plug 16 is installed in a plug housing 14 of a tubing 10. The tubing 10 has a boring 12 with an upper part 10*a* and a lower part 10*b*, being respectively upstream and downstream of the plug 16. Seals 26 can be used in the plug housing 14 combining the two parts 10*a*,10*b* of the tubing.

The plug 16 is seated on a load ring 22, and the plug is sealed against an internal or inside wall 12*a* of the boring 12 using seals 24. The plug 16 is hence preventing fluid flow in the tubing 10. To open for fluid flow, the glass plug 16 is from the upstream side being pressurized and the plug is forced against breaking means, such as breaking pins.

The breaking means are similar for the three disclosed embodiments, and shall now be explained.

The plug 16 is seated on a load ring 22, the load ring 22 being downstream of the plug 16. The load ring 22 is annular shaped and the load ring 22 has one or several breaking pins 18 placed in pockets 28 on an outer circumference, in where the pockets 28 can be shaped as a longitudinal and axial slits on the outside of the load ring 22. The plug 16 and the load ring 22 are axially displaceable in the boring 12 of the plug housing 14.

The breakable glass plug 16, and the load ring 22, is axially movable within the boring 12 between a first position in where the plug 16 is with a distance to at least one of the breaking pins 18 and a second position in where the plug 16 is forced against the breaking pin 18. The load ring 22 is resting on shear lip 20*a* of a shear ring 20, which when subjected to a force higher than a predetermined force breaks and allows axial movement of the load ring 22 and the plug 16 downstream. The shear lip 20*a* is protruding radially inwards in the boring 12.

The breaking pin or pins 18 accommodated in the pocket 28 is resting on an axially extending part 20*b* of the shear ring 20 and the plug 16 is forced against the breaking pin 18 and breaks or is disintegrated.

The seal 24 sealing against the plug 16 and the internal wall 12*a* of the tubing will seal when the plug 16 is in the first position and in the second position.

An advantage of using two rings (a shear ring 20 and a load ring 22) is that the two rings can be made of different materials. The load ring need to be strong to support a high axial load while the shear ring need to have certain material properties to provide accurate and repeatable shear values. Bronze that often is used for application where accurate and repeatable shear values are needed is quite brittle and not suited to be used in the load ring. This type of bronze is also quite expensive, so in a cost perspective it is desirable to limit the quantity needed in a product.

Figure 2:
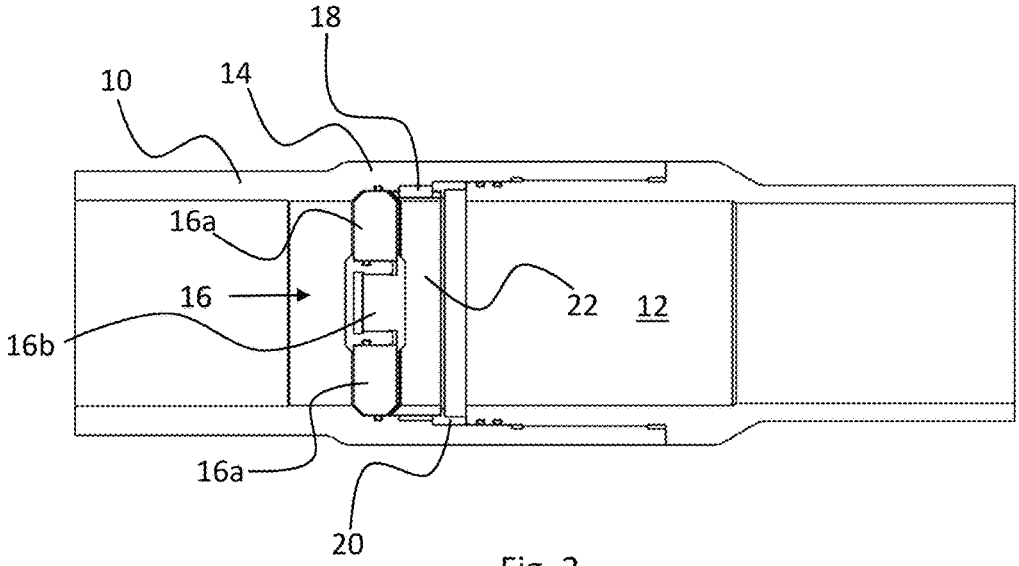
FIGS. 2 and 3 shows a second embodiment of a packer setting device according to the invention.
Figure 3:
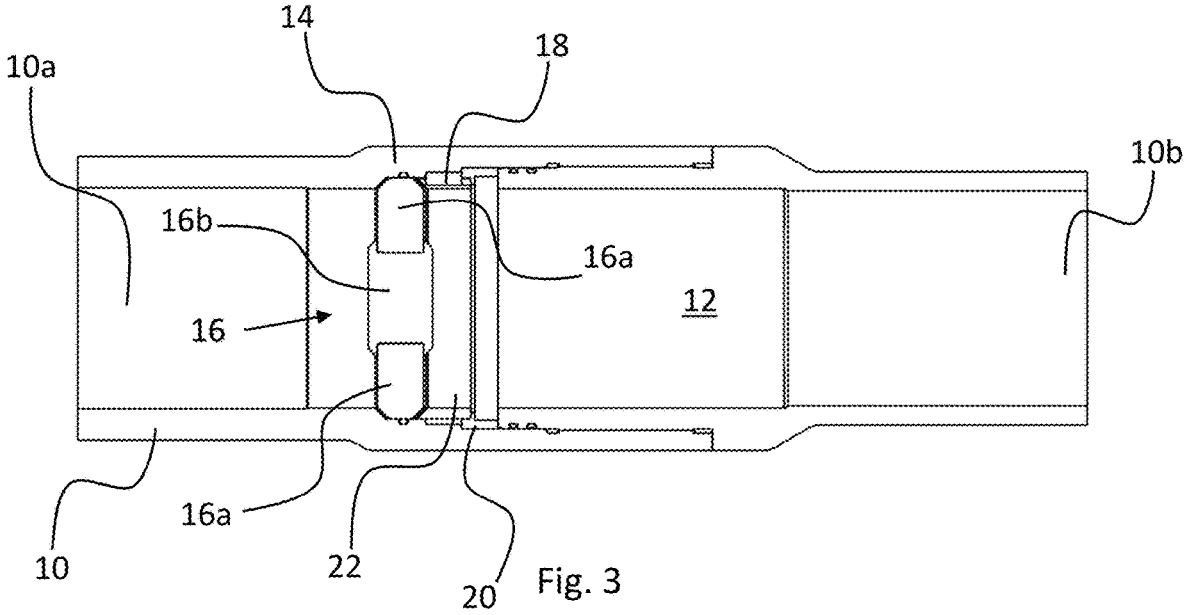
Figure 4:
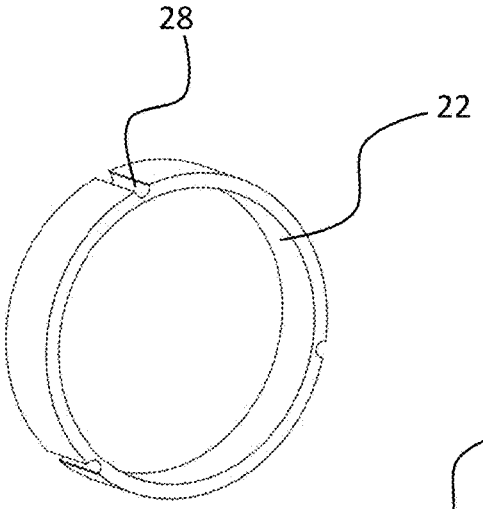
FIG. 4-7 shows details of the packer setting device according to the invention.
Figure 5:
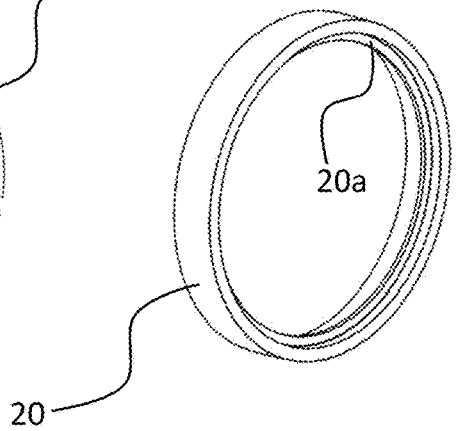
Figure 6:
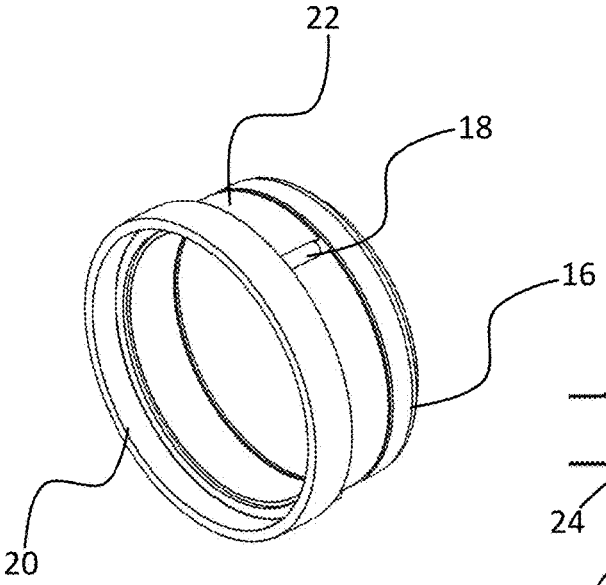
Figure 7:
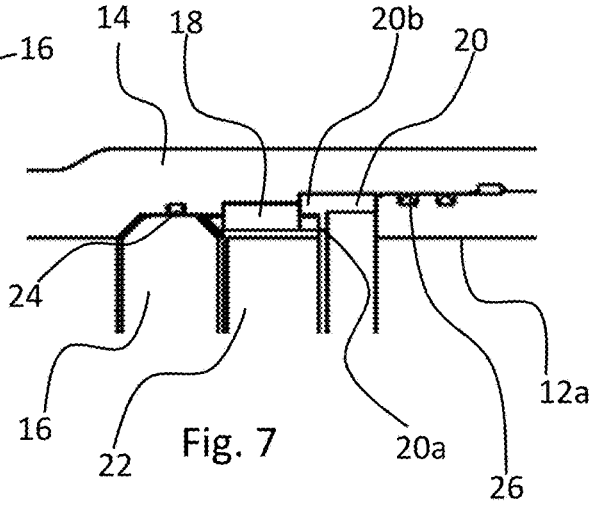

FIGS. 2 and 3 shows that the breakable plug 16 has a doughnut shaped seat 16*a* with a dissolvable insert 16*b*. The dissolvable inserts of FIGS. 2 and 3 are slightly different. In figure FIG. 2, the dissolvable insert 16 is made like a peg or plug inserted in the central doughnut shaped opening of the seat 16*a*, while in FIG. 3 the dissolvable insert 16*b* is integrated in the central doughnut shaped opening of the seat 16*a*.

The glass plug 16 with the dissolvable insert 16*b* is installed as part of the production tubing, and can be used to pressure test the production tubing and to set the production packer.

In some cases, the operator does not have the opportunity to go higher in pressure than the tubing test pressure to open the plug, i.e. if the tubing is tested at 5000 psi, the plug cannot have an opening pressure of 6000 psi because then the pressure limitation on the tubing will be exceeded. This is solved today with, for example, a counting mechanism where a number of pressure pulses are applied to the well (below max pressure) to activate a mechanism that opens the plug. This has its weakness in that the activation mechanism can fail as it often accumulates debris on top of the plug and communication ports gets blocked. These plugs are also expensive to manufacture.

By inserting a dissolvable insert 16*b* into the central opening of the glass plug 16, the plug can be sealed long enough to get a pressure-tight tubing and set the packer, then the insert 16*b* will dissolve and the well can be produced. The glass seat 16*a* can be broken mechanically the next time there is an intervention in the well. The significant benefit of having a small insert 16*b* in the glass plug 16 compared to having a completely soluble plug that seals the whole tube is that the soluble plugs can take a long time to dissolve.

The other function of the dissolvable insert 16*b* is that it acts as a backup solution if the plug opening mechanism fails. If the plug does not open as it should at a shear pressure of, for example, 5000 psi, one can only wait until the plug opens itself A third function is if here are reasons that the operator will not pressurize the well to activate the plug, it will open by itself when the insert 16*b* is dissolved. If it is desirable to remove the remaining glass seat 16*a* without entering the well, a ball can be released into the well, the ball will land in the opening of the seat 16*a*, and the remaining glass can be broken by building differential pressure until the plug breaks.

Figure 8:
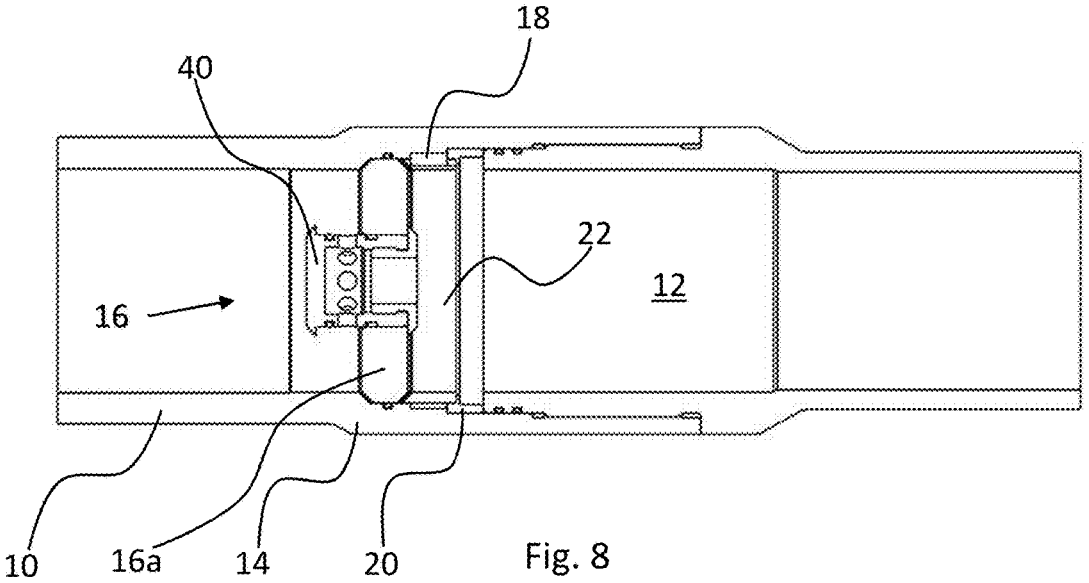
FIG. 8-10 shows a third embodiment of a packer setting device according to the invention.
Figure 9:
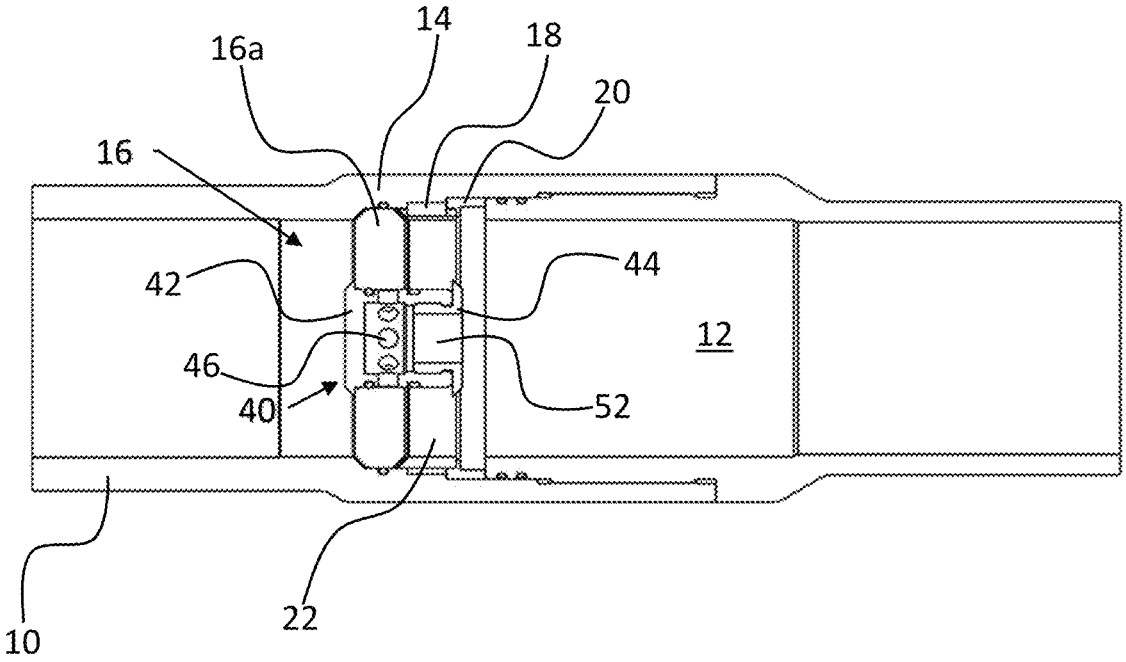
Figure 10:
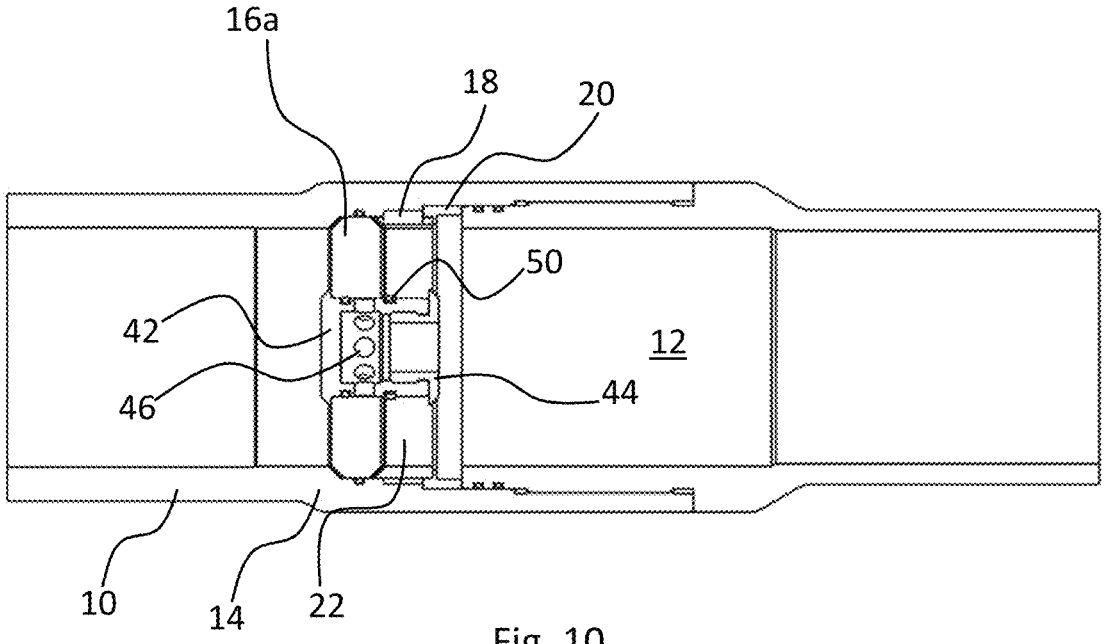

A third embodiment of the packer setting device according to the invention is shown in FIGS. 8-10, in where the breakable glass plug 16 similarly comprises a doughnut shaped seat 16*a* made of breakable material, but a non-return valve 40 is disposed in the central opening of the doughnut shaped seat 16*a*. The non-return valve 40 will in a first position be open to allow fluid flow through the valve, and in a second position, the non-return valve 40 is closed to seal the plug 16.

The non-return valve 40 can for instance comprise a first annular peg 42 with a number of radial openings 46, which is inserted in the doughnut shaped opening of the seat 16*a* from a first side, and a second annular peg 44 with an axial peg boring 52, which is inserted in the doughnut shaped opening of the seat 16*a* from a second side.

In FIG. 8, the non-return valve 40 is open, and fluid is displacing from bottom to top.

In FIG. 9, the non-return valve is closed, and pressurized from top.

Production tubing with the plug 16 can be run into the well and the production tubing will automatically be filled through the non-return valve 40. When the tubing is to be tested and the packer is installed, the well will be pressurized from the top and the non-return valve 40 will close and seal. The glass seat 16*a* can then be removed by pressuring up the well from the top to the predetermined opening pressure of the glass plug.

If a well control situation occurs during entry, it will be possible to remove the plug by increasing pressure until the glass is broken and it can be pumped at high rate to control the well.

A second embodiment of the non-return valve 40 is shown in FIG. 10, in where the valve 40 has a locking ring 50 so that when the valve sees a pressure from the top, the valve moves to the closed position, shown in FIG. 9, and the locking ring 50 engages on the lower side of the opening of the glass seat 16*a* and the valve 40 is permanently closed. The plug 16 can then be used as a barrier both from top and lower side. To open the non-return valve 40, the locking ring 50 can be dissolvable.

In one possible embodiment the non-return valve 40 can be dissolvable.

FIG. 11-14 shows application of possible embodiments of the invention. The main operational stages using a crushable plug 16 with a dissolvable insert 16*b* is described in the following text.

Figure 11:
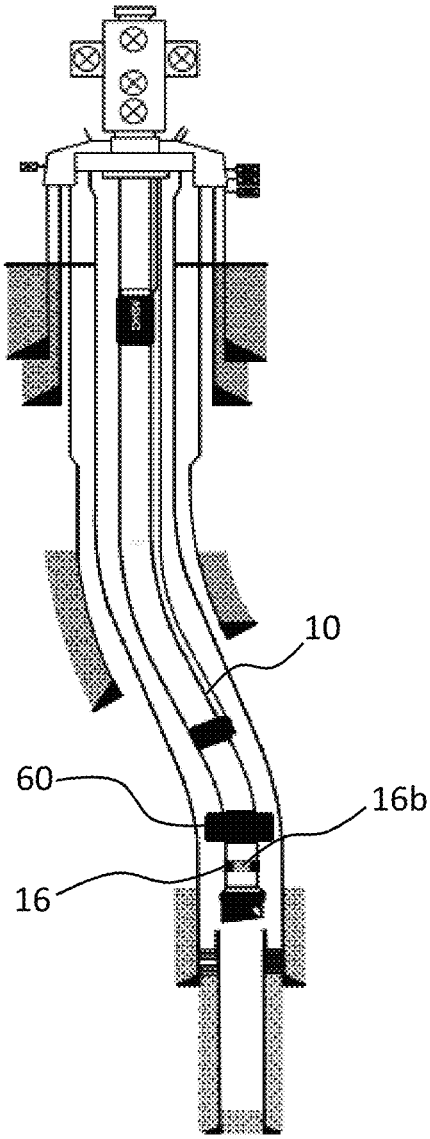
FIG. 11-14 shows application of a possible embodiment of the invention.

In FIG. 11 the plug 16 is installed below the production packer 60 in the tubing 10 and the tubing 10 is run in hole closed end. The tubing 10 can be filled from top, or a circulation sub or similar circulation point can be installed in the tubing above the plug 16.

Figure 12:
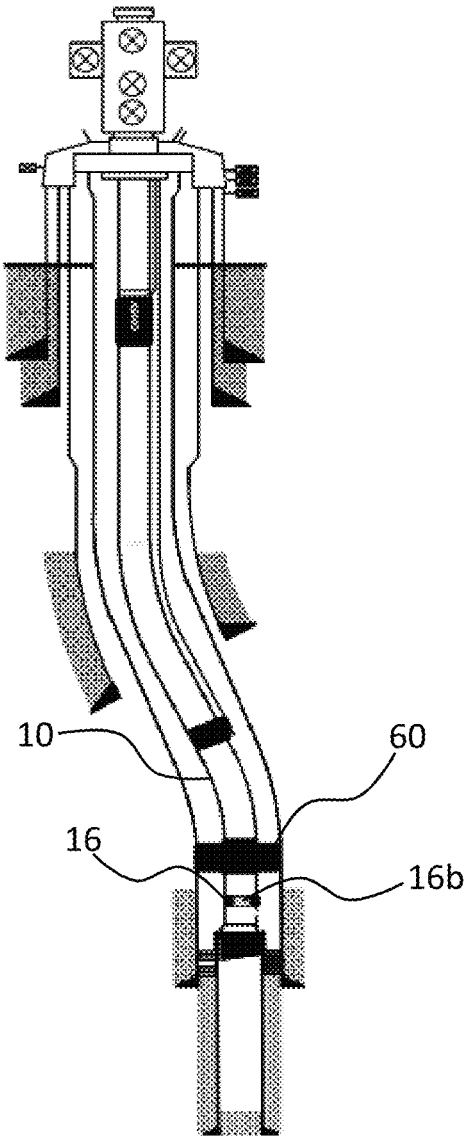
Figure 13:
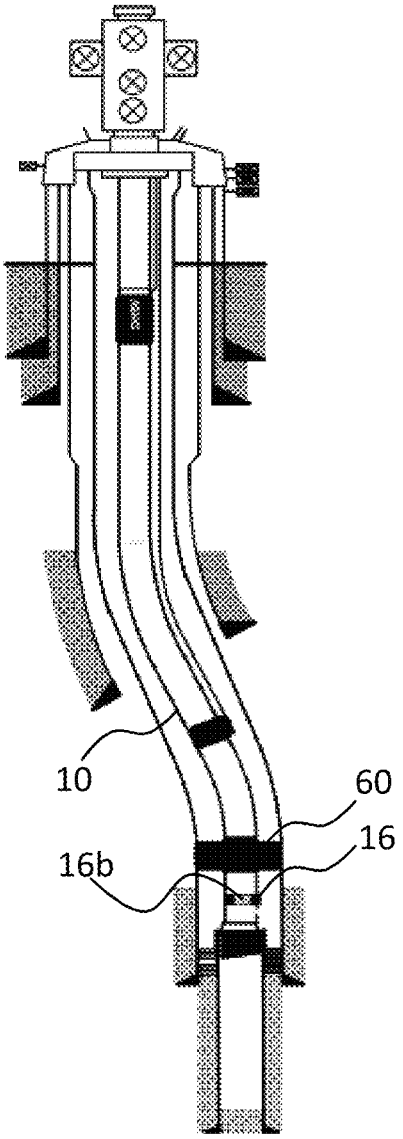

In FIG. 12, the tubing 10 have reached the desired depth, pressure is applied from the surface inside the tubing 10 against the plug 16 to set the production packer 60.

In FIG. 13 pressure is again applied to a predefined value to shear out and shatter the plug 16. In an alternative embodiment, the plug 16 can be shattered applying pressure cycles. At this stage if the breaking mechanism for shattering the plug 16 fails, a backup solution is to wait until the dissolvable insert 16*b* of the plug 16 dissolves and opens up the well for production. Later the crushable remains of the plug 16 (the seat 16*a*) can be shattered for instant mechanically during interventions.

Figure 14:
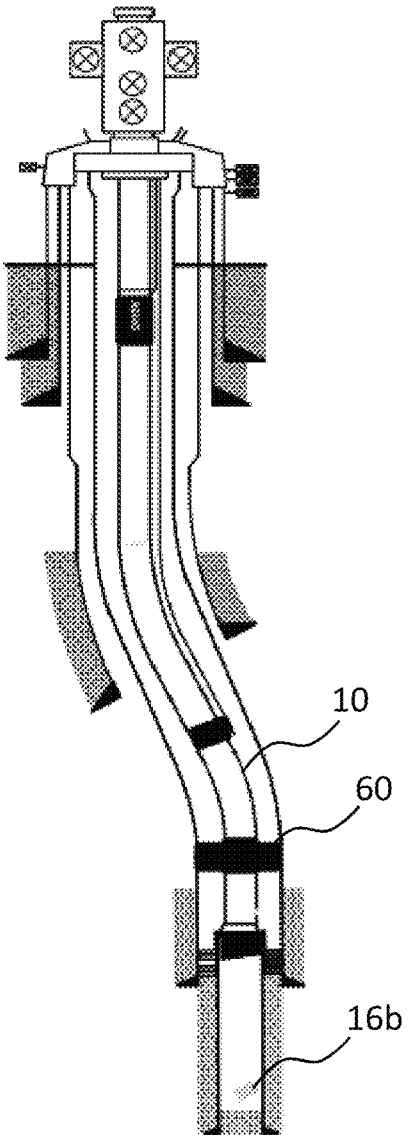

In FIG. 14, the plug 16 is shattered, and the well is open for production. The not yet dissolved insert 16*b* of the plug 16 falls into the well.

FIG. 15-18 shows application of possible embodiments of the invention. The main operational stages using a plug 16 with a non-return valve 40 as described previously.

Figure 15:
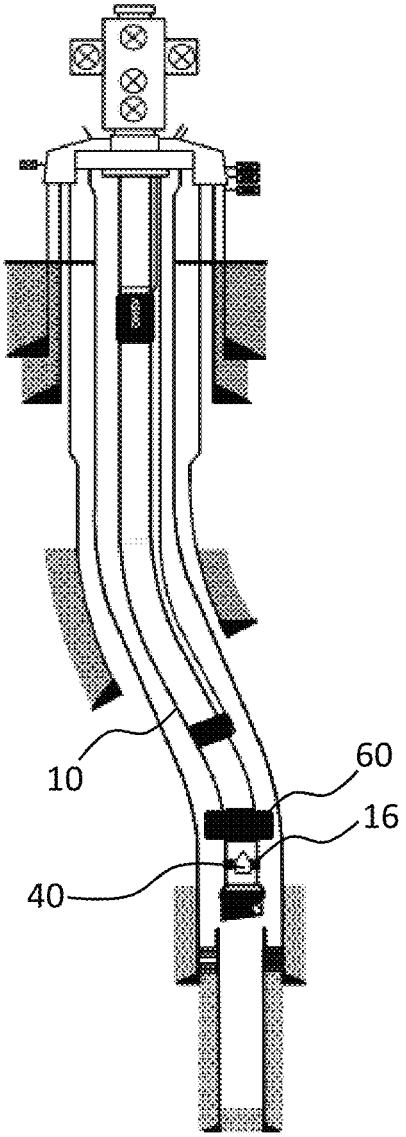
FIG. 15-18 shows application of another possible embodiment of the invention

In FIG. 15 the plug 16 is installed below the production packer 60 in the tubing 10 and the tubing 10 is run in hole open ended. The tubing 10 will be filled through the non-return valve 40 as it is run in hole.

Figure 16:
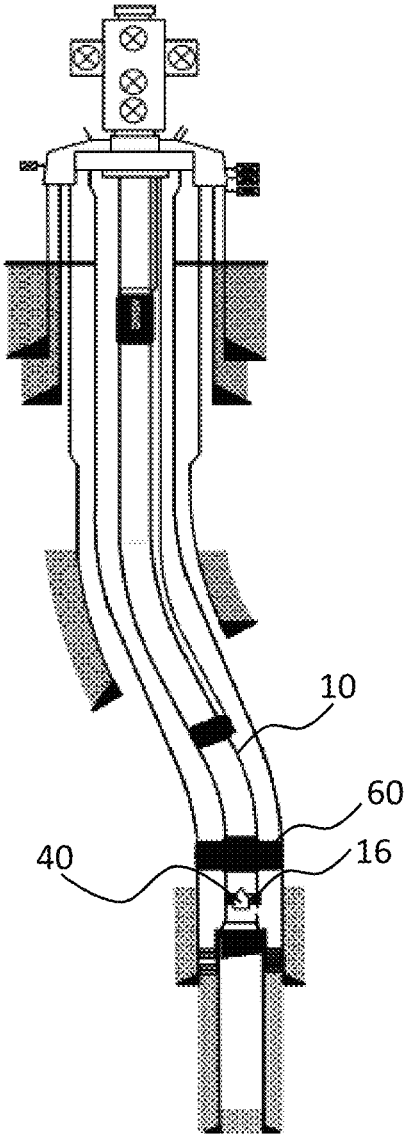
Figure 17:
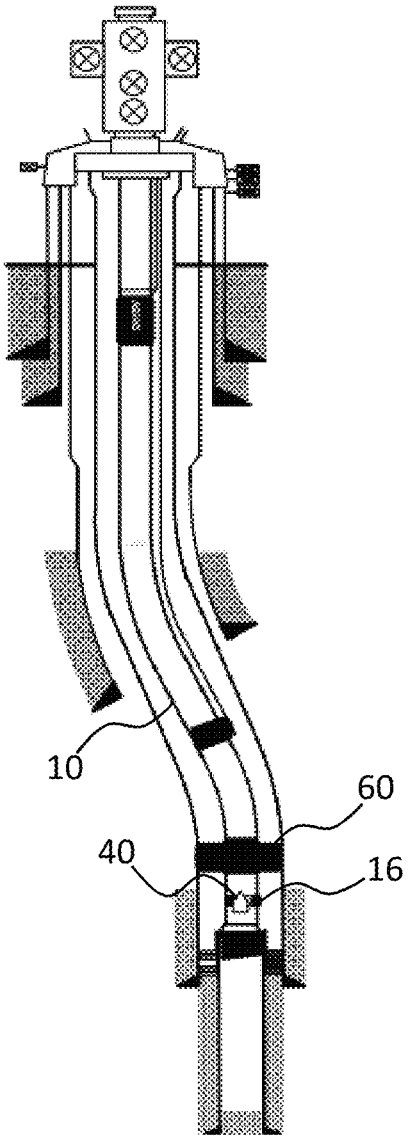

In FIG. 16, the tubing has reached the desired depth, pressure is applied from the surface inside the tubing 10 against the plug 16 to set the production packer 60. As the non-return valve 40 only allows fluid flow into the tubing 10 and not out of the tubing 10, the pressure required to set the production packer 60 can be achieved inside the tubing 10.

In FIG. 17 pressure is again applied to a predefined value to shear out and shatter the plug 16. In an alternative embodiment, the plug 16 can be shattered applying pressure cycles. If a dissolvable or partly dissolvable insert 16*b* is used, a backup solution will be to wait for the insert to dissolve in case the shattering of the plug 16 fails.

Figure 18:
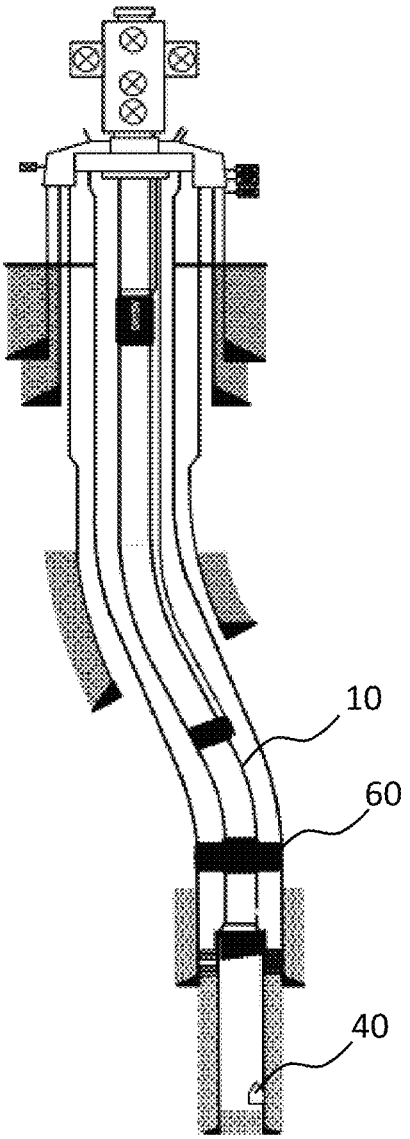

In FIG. 18, the plug 16 is shattered, the well is open for production and the non-return valve 40 fall to the bottom of the well.

The invention claimed is:

1. A packer setting device, comprising:

a tubing with a plug housing, said plug housing having an internal, through running boring with an internal wall, a breakable plug seated on a load ring axially movable within the boring between a first position in where the plug is a distance from a breaking pin and a second position in where the plug is forced against the breaking pin, wherein said load ring is resting on a shear ring with an annular shear lip preventing axial movement in the first position until the shear lip is subjected to a force higher than a predetermined force, wherein the annular shear lip of the shear ring extends radially inward in the boring, and the breaking pin is resting on the shear ring, and said breaking pin is accommodated in a pocket on an outside of the load ring.

2. The packer setting device according to claim 1, wherein the breaking pin is resting on an axially extending part of the shear ring.

3. The packer setting device according to claim 1, wherein said pocket accommodating the breaking pin is a longitudinal and axial slit on the outside of the load ring.

4. The packer setting device according to claim 1, wherein the breakable plug comprises a doughnut shaped seat made of breakable material, and a dissolvable insert made of dissolvable material.

5. The packer setting device according to claim 4, wherein the dissolvable insert is inserted or integrated in a central opening of the doughnut shaped seat.

6. The packer setting device according to claim 1, wherein the breakable plug comprises a doughnut shaped seat made of breakable material, and a non-return valve disposed in a central opening of the doughnut shaped seat.

7. The packer setting device according to claim 6, wherein the non-return valve in a first position is open, allowing fluid flow through the valve, and in a second position, when the tubing is pressurized from top, the non-return valve is closed, sealing the plug.

8. The packer setting device according to claim 6, wherein the non-return valve comprises a first annular peg with a number of radial openings, and a second annular peg with an axial peg boring, said second annular peg being inserted in the first annular peg.

9. The packer setting device according to claim 7, wherein the non-return valve comprises a locking ring locking the valve in the second sealed position.

10. The packer setting device according to claim 9, wherein the non-return valve is dissolvable.

* * * * *